US007458878B2

(12) United States Patent
Walsh et al.

(10) Patent No.: US 7,458,878 B2
(45) **Date of Patent: *Dec. 2, 2008**

(54) GRINDING APPARATUS AND METHOD

(75) Inventors: Thomas A. Walsh, Templeton, CA (US); Salman Moudrek Kassir, Paso Robles, CA (US)

(73) Assignee: Strasbaugh, a California corporation, San Luis Obispo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/548,213

(22) Filed: Oct. 10, 2006

(65) Prior Publication Data

US 2007/0128983 A1 Jun. 7, 2007

Related U.S. Application Data

(63) Continuation of application No. 10/407,833, filed on Apr. 4, 2003, now Pat. No. 7,118,446.

(51) Int. Cl.
*B24B 49/00* (2006.01)
*B24B 51/00* (2006.01)
*B24B 1/00* (2006.01)

(52) U.S. Cl. ..... 451/5; 451/8; 451/41; 451/63; 451/56

(58) Field of Classification Search ..... 451/5, 451/8, 41, 63, 285–289, 390, 397, 398, 402, 451/444, 56, 58

See application file for complete search history.

(56) References Cited

U.S. PATENT DOCUMENTS 1,963,394 A * 6/1934 Yassenoff ..... 451/65
2,309,016 A * 1/1943 Ryan ..... 451/548

(Continued)

FOREIGN PATENT DOCUMENTS

DE 4208615 8/1993

(Continued)

OTHER PUBLICATIONS

Office Action from U.S. Appl. No. 10/407,833 dated Apr. 14, 2004.

(Continued)

*Primary Examiner*—Maurina Rachuba
(74) *Attorney, Agent, or Firm*—Thomas F. Lebens; Sinsheimer Juhnke Lebens & McIvor, LLP

(57) ABSTRACT

The present embodiments provide methods, systems and apparatuses for use in grinding work pieces, such as wafers. Some embodiments provide methods that position a grind spindle to contact a first grinding spindle to a face of a work piece, remove a portion of the face, and control the removing of the portion of the face according to a control algorithm. This control algorithm can comprise determining a force applied to the work piece during the removing of the portion of the face, adjusting a feed rate of the first grind spindle when the force applied to the work piece has a predefined relationship with a first threshold level; and dressing a portion of the first grinding portion when the force applied to the work piece has a predefined relationship with a second threshold level that is greater than the first threshold.

19 Claims, 17 Drawing Sheets

U.S. PATENT DOCUMENTS

| | | | | | |
|---|---|---|---|---|---|
| 2,414,056 | A | * | 1/1947 | Nieman | 433/51 |
| 2,420,504 | A | * | 5/1947 | Gilbert | 451/65 |
| 2,425,469 | A | * | 8/1947 | Hanrahan et al. | 451/65 |
| 2,673,425 | A | * | 3/1954 | Karnell | 451/548 |
| 2,793,473 | A | * | 5/1957 | Hickman | 451/65 |
| 2,797,533 | A | * | 7/1957 | Bluemink | 451/226 |
| 2,948,008 | A | * | 8/1960 | Leeds et al. | 401/263 |
| 4,226,053 | A | * | 10/1980 | Inoue | 451/5 |
| 5,035,087 | A | * | 7/1991 | Nishiguchi et al. | 451/14 |
| 5,174,270 | A | * | 12/1992 | Katayama et al. | 125/13.02 |
| 5,827,112 | A | * | 10/1998 | Ball | 451/21 |
| 5,864,238 | A | * | 1/1999 | Iijima et al. | 324/545 |
| 6,152,806 | A | * | 11/2000 | Nystrom | 451/36 |
| 6,179,695 | B1 | * | 1/2001 | Takahashi et al. | 451/287 |
| 6,319,097 | B1 | * | 11/2001 | Coverdale et al. | 451/49 |
| 6,336,849 | B1 | * | 1/2002 | Konnemann | 451/259 |
| 6,386,956 | B1 | * | 5/2002 | Sato et al. | 451/57 |
| 6,565,421 | B1 | * | 5/2003 | Choo | 451/41 |
| 7,118,446 | B2 | * | 10/2006 | Walsh et al. | 451/5 |

FOREIGN PATENT DOCUMENTS

| | | |
|---|---|---|
| DE | 19641534 | 4/1998 |
| JP | 6094266 | 5/1985 |
| JP | 1047350 | 2/1998 |

OTHER PUBLICATIONS

Office Action from U.S. Appl. No. 10/407,833 dated Oct. 29, 2004.

Office Action from U.S. Appl. No. 10/407,833 dated Jan. 6, 2005.

Office Action from U.S. Appl. No. 10/407,833 dated Jul. 1, 2005.

Office Action from U.S. Appl. No. 10/407,833 dated Oct. 14, 2005.

Notice of Allowance from U.S. Appl. No. 10/407,833 dated Jun. 5, 2006.

International Search Report+Written Opinion, PCT/US2004/009676, WO04091856, mail date Dec. 30, 2004.

Knapp, Byron et al., "Superabrasive Grinding Process Optimization through Force Measurement", *Proc. of the 2001 ASPE Annual Meeting*, Pennsylvania State University University Park, PA 16802 http://www.me.psu.edu/mdrl/docs/instgrind.pdf.retrieved 4/2/2003, et al = Eric Marsh, Robert Grejda, David Schalcosky,(Apr. 2, 2003),58-61.

Interview Summary from U.S. Appl. No. 10/407,833 dated Feb. 15, 2006.

Walsh, Thomas "U.S. Appl. No. 10/407,833".

* cited by examiner

GRINDING APPARATUS AND METHOD

PRIORITY CLAIM

This application is a continuation of application Ser. No. 10/407,833, filed Apr. 4, 2003 and entitled GRINDING APPARATUS AND METHOD, which is incorporated herein by reference in its entirety.

BACKGROUND OF THE INVENTION

1. Field of the Invention

The present invention relates generally to material processing, and more specifically to grinding technologies. Even more specifically, the present invention relates to surface and edge grinding technologies.

2. Discussion of the Related Art

The use of the semiconductor devices in today's commercial goods is undergoing dramatic growth. In order to expand the use of semiconductor devices in lower cost traditional products, semiconductor devices must be produced at previously unattainable low cost and with smaller size active devices and smaller line widths. Virtually every step of semiconductor device production is undergoing extensive investigation in an effort to obtain efficiencies and cost savings that will expand the market for semiconductor products.

Among the newer methods is the use of "Silicon on Insulator" and other bonding techniques where multiple silicon or other materials are bonded together then thinned to achieve desired performance. Such techniques increase efficiency of operation, lower the cost of semiconductor devices and also enable further progress in state of the art technologies.

It is generally recognized that substantial cost savings can be employed if large-scale manufacturing techniques can be brought to bear on whole wafers containing multiple, usually identical electronic devices which are simultaneously formed on the wafer substrate, prior to the wafer being divided into individual units or dies.

It has been found efficient in constructing semiconductor wafers that a substrate of semiconductor material, for example, silicon, receives overlying layers of active devices and inter-layer interconnects. After each layer is formed on the substrate, the front or active surface of the wafer is planarized or flattened so that succeeding layers are formed with a desired registry and upright orientation.

Exceedingly stringent flatness requirements are necessary for small-dimensioned patterning. As the layers are built up, one upon the other, a variety of electronic devices are formed on the wafer substrate and typically multiple, identical devices are simultaneously formed in the layer-by-layer operations. Usually, only the active or front side of the wafer undergoes extensive flattening, with the reverse or backside remaining free of layering processes and the need for precision flattening steps.

However, for larger wafers, such as the 300 mm diameter size now growing in popularity, extremely demanding flatness and surface finishing is required for both sides of the wafers. As will be appreciated, the techniques used for layer fabrication and the flattening processes cause stress inducing forces to be stored within the wafer construction. Gross chemical and atomic-level forces also are imparted to the internal structure of the semiconductor wafer and contribute to its loss of mechanical ruggedness.

Semiconductor wafers have been increasing in size in recent years in order to achieve efficiencies and cost reductions in manufacture. While most devices wafers are 6" in diameter, a large fraction are now 8", and the industry is tooling up for 12" diameter wafers. These larger wafers take up much floor space and require large and heavy equipment that sometimes cannot be placed on upper floors of fabrication facilities. So for 12" processing there is great benefit from more compact grinding equipment.

A process of bonding multiple wafers together is a newer method to fabricate these semiconductor devices. These bonded wafers require new surface finishing techniques to achieve the required flatness and surface finishes. After completing final fabrication of the multiple devices on the bonded wafers, the second wafer is then thinned from the backside to achieve the required final thickness. This is generally achieved with commercial wafer back grinders such as provided by Strasbaugh, Disco or by G&N. Such commercial grinders are typically two-step grinding with the first step done on a first rotating spindle by a coarse grind abrasive wheel, and the second step done on a separate grind spindle with a fine grind abrasive. The work piece is typically held and rotated on a chuck that retains the wafer by vacuum in a secure and flat or near flat configuration. The relative motion between the rotating grind wheel and the rotating work piece and the force provided between the two creates the energy needed to suitably grind the surfaces.

SUMMARY OF THE INVENTION

In one embodiment, the invention can be characterized as a grinding apparatus comprising a grind spindle, and the grind spindle comprises an axis; a first and second face grinding portions engaged with the grind spindle, wherein the first and second face grinding portions are axially disposed and configured to rotate about the axis; an edge grinding portion engaged with the grind spindle wherein the edge grinding portion is radially disposed with respect to the axis and configured to rotate about the axis.

In another embodiment, the invention can be characterized as a method, and means for accomplishing the method, for grinding, the method comprising: positioning a grind spindle comprising a plurality of grinding portions over a work piece; removing a portion of an edge of the work piece with one of the plurality of grinding portions; and removing a portion of a face of the work piece with one of the plurality of grinding portions.

In a further embodiment, the invention may be characterized as a grinding apparatus comprising: a grind spindle comprising an axis; a face grinding portion engaged with the grind spindle wherein the face grinding portion is axially disposed and configured to rotate about the axis; a cooling duct comprising a terminating portion, the terminating portion being radially and axially disposed with respect to the axis, wherein the cooling duct comprises a terminating aperture juxtaposed with the face grinding portion.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION

Figure 1A:
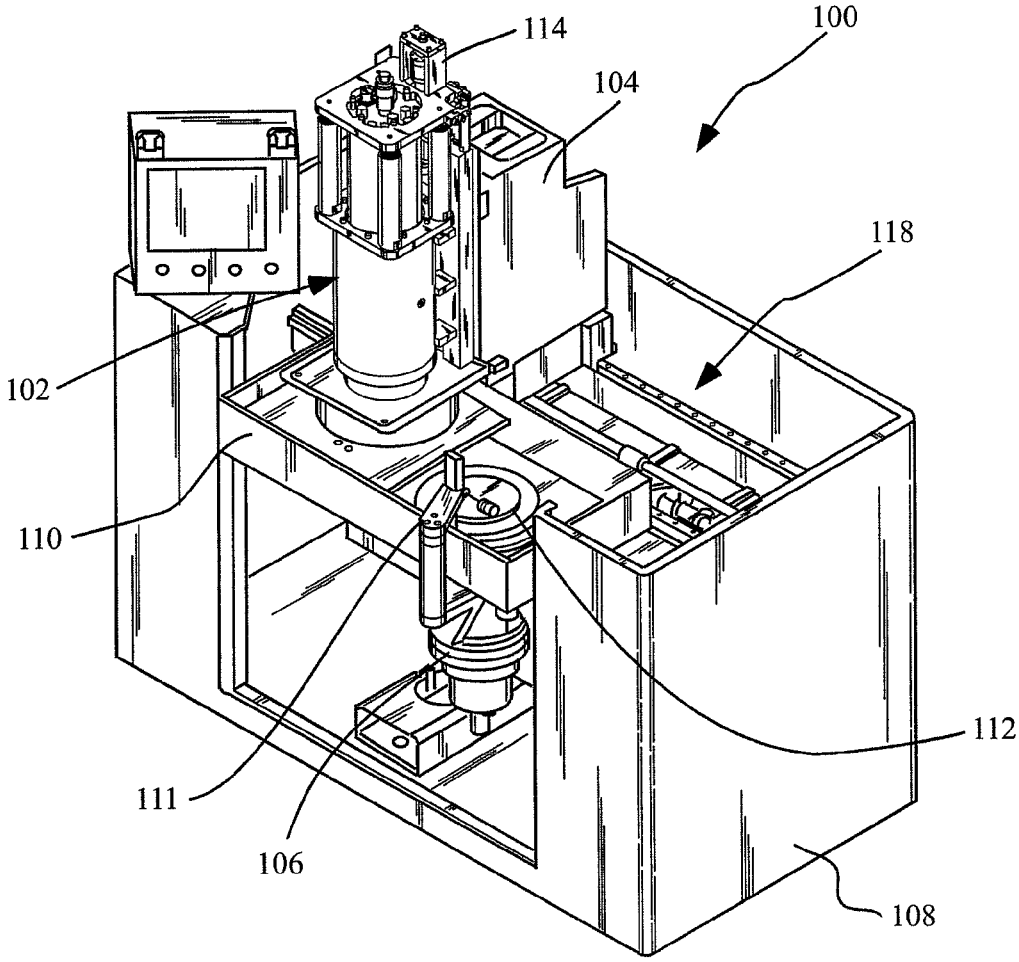
FIGS. 1A, 1B, 1C and 1D are perspective, plan, front and side views respectively of one embodiment of a compact grinder assembly in accordance with one embodiment of the present invention.
Figure 1B:
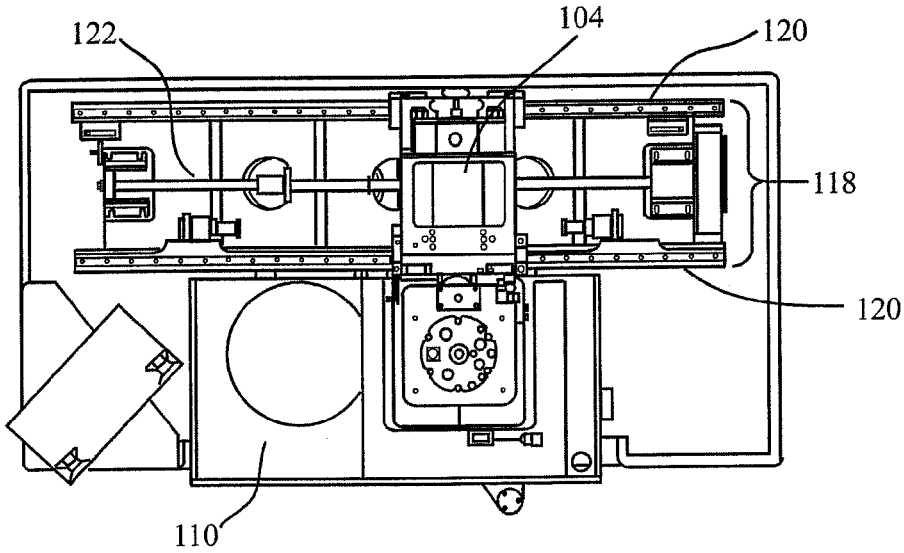
Figure 1C:
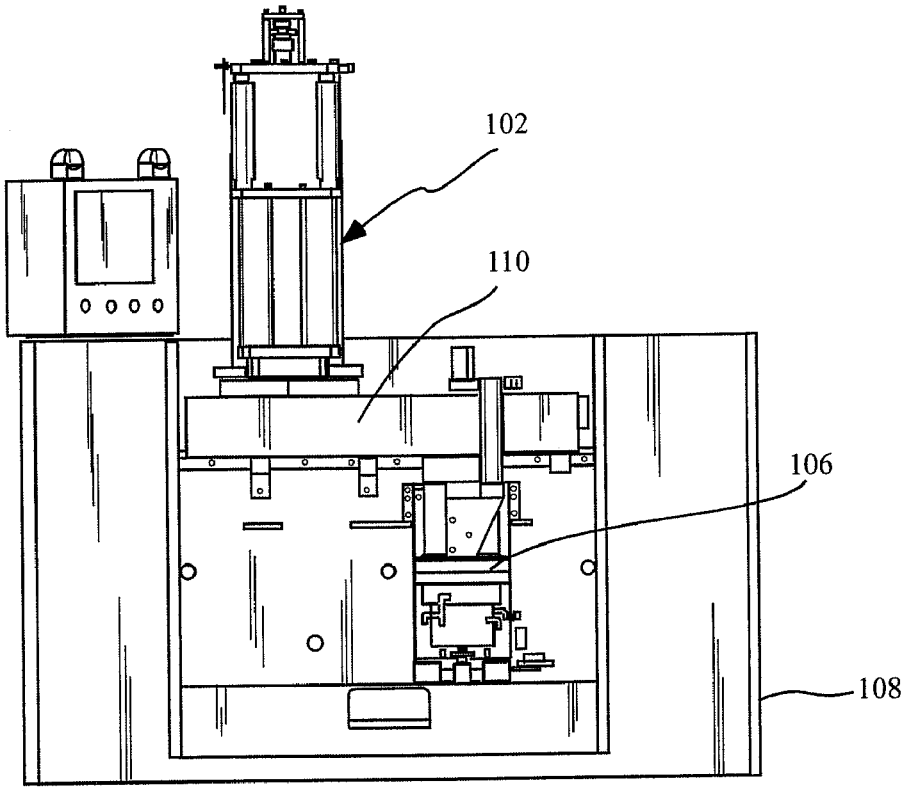
Figure 1D:
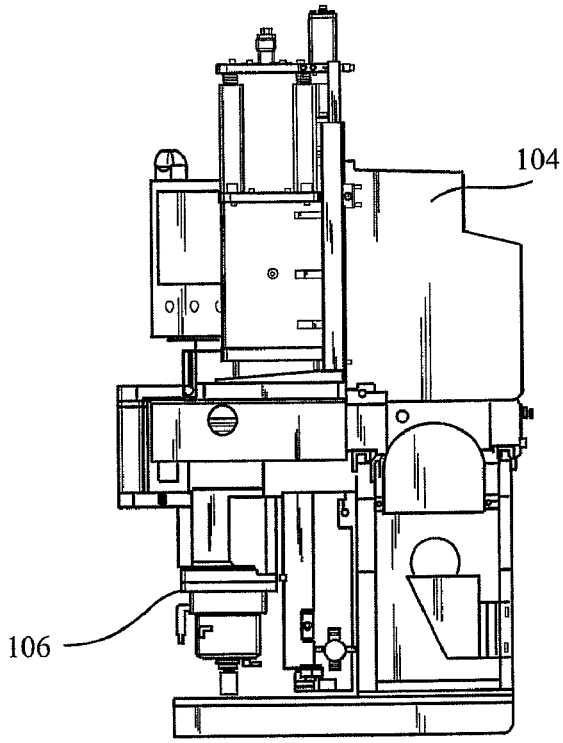

The following description is not to be taken in a limiting sense, but is made merely for the purpose of describing the general principles of the invention. The scope of the invention should be determined with reference to the claims.

Referring first to FIGS. 1A, 1B, 1C and 1D shown are perspective, plan, front and side views respectively of one embodiment of a compact grinder assembly 100 in accordance with one embodiment of the present invention. Shown is a grind spindle 102, a spindle support column 104, a work spindle 106, a cabinet 108, a splash pan 110, a chuck 112, a thickness probe 111, a ball screw assembly 114, a bed portion 118, rails 120 and a ball screw 122.

The grind spindle 102 is coupled with the spindle support column 104, and the spindle support column 104 is engaged with the rails 120 and the ball screw 122. The cabinet 108 supports the rails 120, ball screw 122, the work spindle 106 and the splash pan 110. The thickness probe 111 is coupled with the work spindle 106 and is shown positioned above the chuck 112.

In several embodiments, the grind spindle 102 is moved along a vertical axis by the ball screw assembly 114 and includes at least one grinding wheel (not shown) in order to shape a work piece, for example, semiconductor wafers.

The chuck 112 holds the work piece in place so that the work piece does not slip or otherwise move while being shaped by a grinder of the grind spindle 102. For example, the chuck 112 in one embodiment is porous, e.g. it has holes drilled through it or otherwise comprises a porous material, and a partial vacuum is provided below the chuck 112 to hold the work piece in place.

The spindle support column 104, according to several embodiments, supports the grind spindle 102, and is moveably engaged with and supported by the tracks 120. This allows the spindle support column 104, and hence the grind spindle 102, to translate back and forth in a horizontal direction. Specifically, the spindle support column 104, and the grind spindle 102 move with respect to the cabinet 108, the work spindle 106, and thus a surface of a stationary work piece on the chuck 112.

Figure 3:
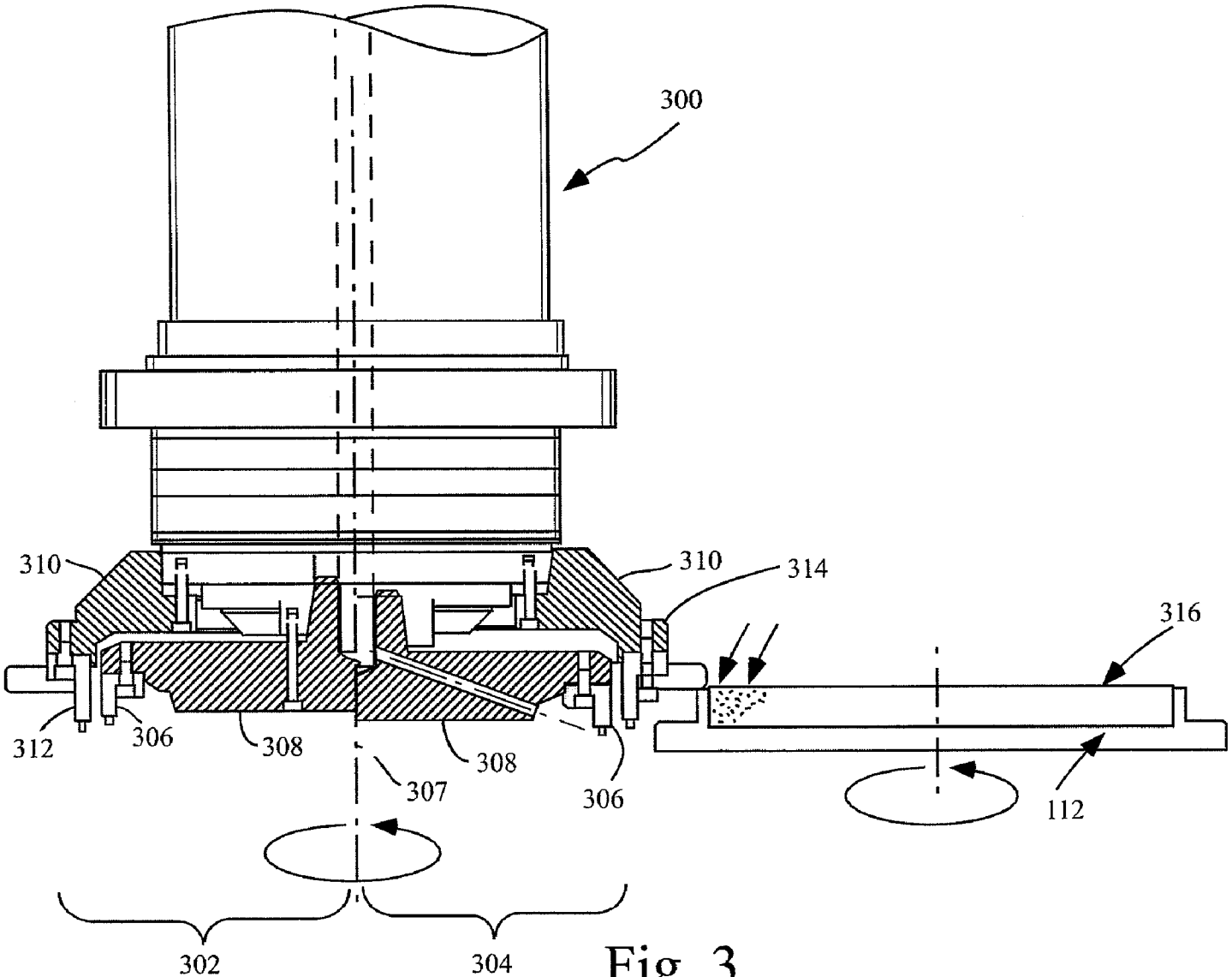
FIG. 3 is a partial view of a grind spindle performing edge grinding of a work piece in accordance with one embodiment of the present invention.
Figure 4:
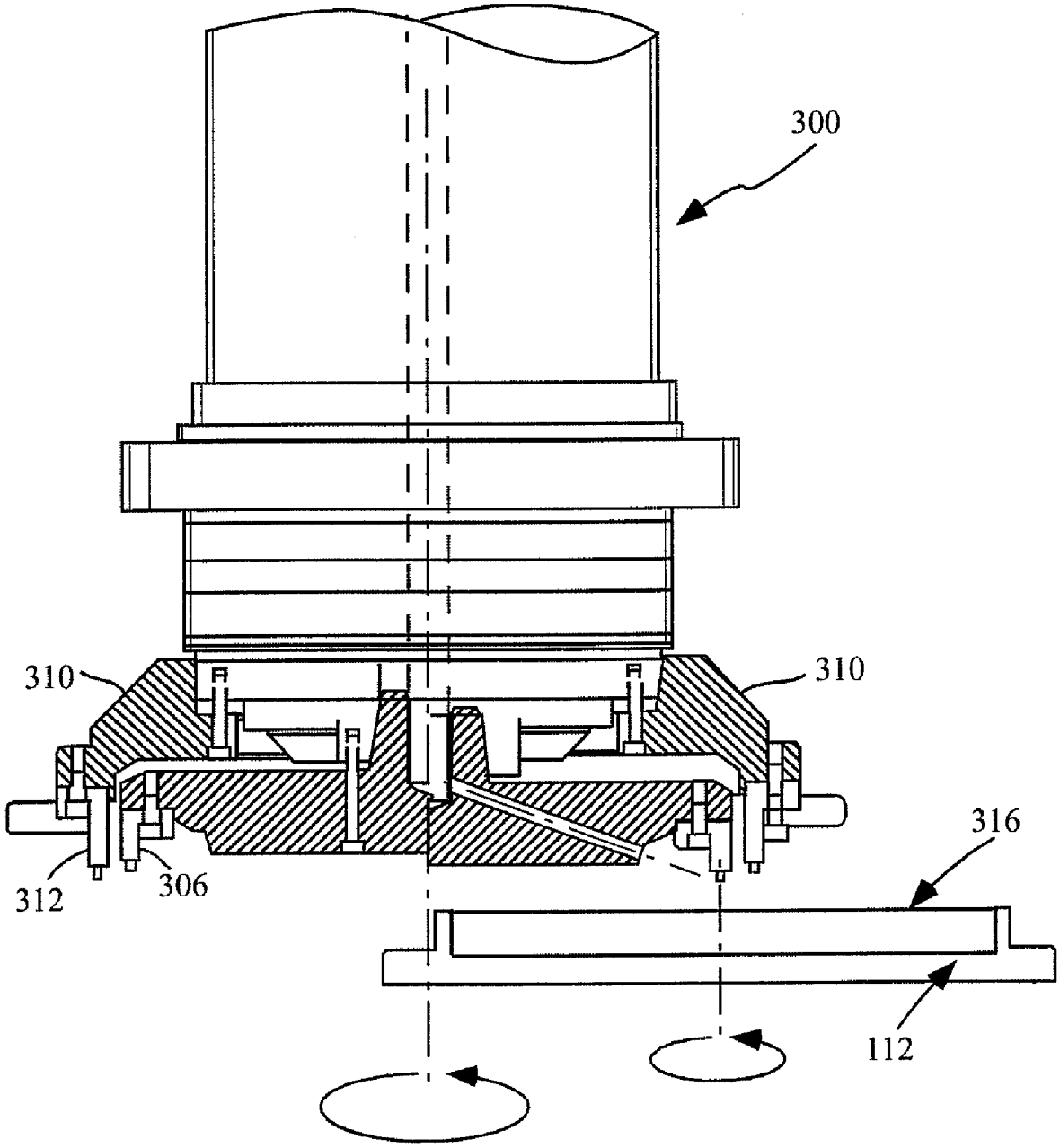
FIG. 4 is a partial view of the grind spindle of FIG. 3 positioned with an inner grinding wheel placed in contact with the wafer to perform face grinding.

As discussed further with reference to FIGS. 3 and 4, the ability to translate the grinding assembly 102 allows shaping of a work piece to be achieved on both a face and an edge of the work piece with a single machine. Specifically, in several embodiments, a grinding wheel of the grind spindle 102 is first positioned over an edge of the work piece and then moved into contact with the edge of the work piece until the edge is shaped as desired. The grind spindle 102 is then raised vertically above the work piece, translated horizontally over a face of the work piece so the grinding wheel is positioned over the face of the work piece, and then the grinding wheel is then placed in contact with the face of the work piece by lowering the grind spindle 102 until the grinding wheel is in contact with a portion of the face of the work piece.

Grinding a work piece, e.g., a semiconductor wafer, to thin thickness or grinding a top bonded wafer on a bonded pair of wafers to a very thin thickness dimension often causes unacceptable edge chipping of the thinned work piece because the work piece edge is initially profiled into a rounded shape, and when ground thin, the edge becomes a protruding and unsupported sharp edge of, e.g., silicon. In several embodiments of the present invention, this problem is alleviated or eliminated by first edge-grinding the wafer to be thinned.

Heretofore, such grinding required two tools: a wafer edge grinder and a face grinder to, e.g., thin a front-side bonded wafer. Thus, the compact grinder assembly 100 according to several embodiments reduces the number of tools required to edge and face grind, and thus, saves space and cost over previous processing methods that require independent and separate tools.

In several embodiments of the present invention, as discussed further with respect to FIGS. 3 and 4, grinding is carried out with two independent grinding wheels that are both mounted on a same drive spindle (not shown) within the grind spindle 102. Such a design further saves space, weight and cost because a single spindle drive potentially replaces two separate grinders or replaces grinders that have two spindles.

In several of these embodiments that include two grinding wheels, one of the grinding wheels is a coarse-abrasive grinding wheel and the other is a fine-abrasive grinding wheel. In many of these embodiments of the present invention, the two wheels have different diameters, with one wheel being mounted inside the other, and separate control is provided to each wheel to move either one or the other wheel down upon the work piece. Either the coarse or the fine wheel can be the inner wheel, but the preferred embodiment has been the coarse wheel at the inner position.

Movement of wafers from one tool to another requires placing the wafers in a cassette or FOUP (Front Opening Unified Pods) so they can be safely transferred to the next process step as a group or batch in a protected and safe mode. However, large wafer FOUPS are expensive and usually maintained in pristine cleaned condition inside the FOUPS. Thus, movement of wafers which are freshly ground with grinding swarf and water on them will contaminate the FOUPS unless the wafers are entirely cleaned before placement or the FOUPS are cleaned after transfer, both adding expensive steps. Such steps are eliminated by the present embodiment of this invention.

Figure 9:
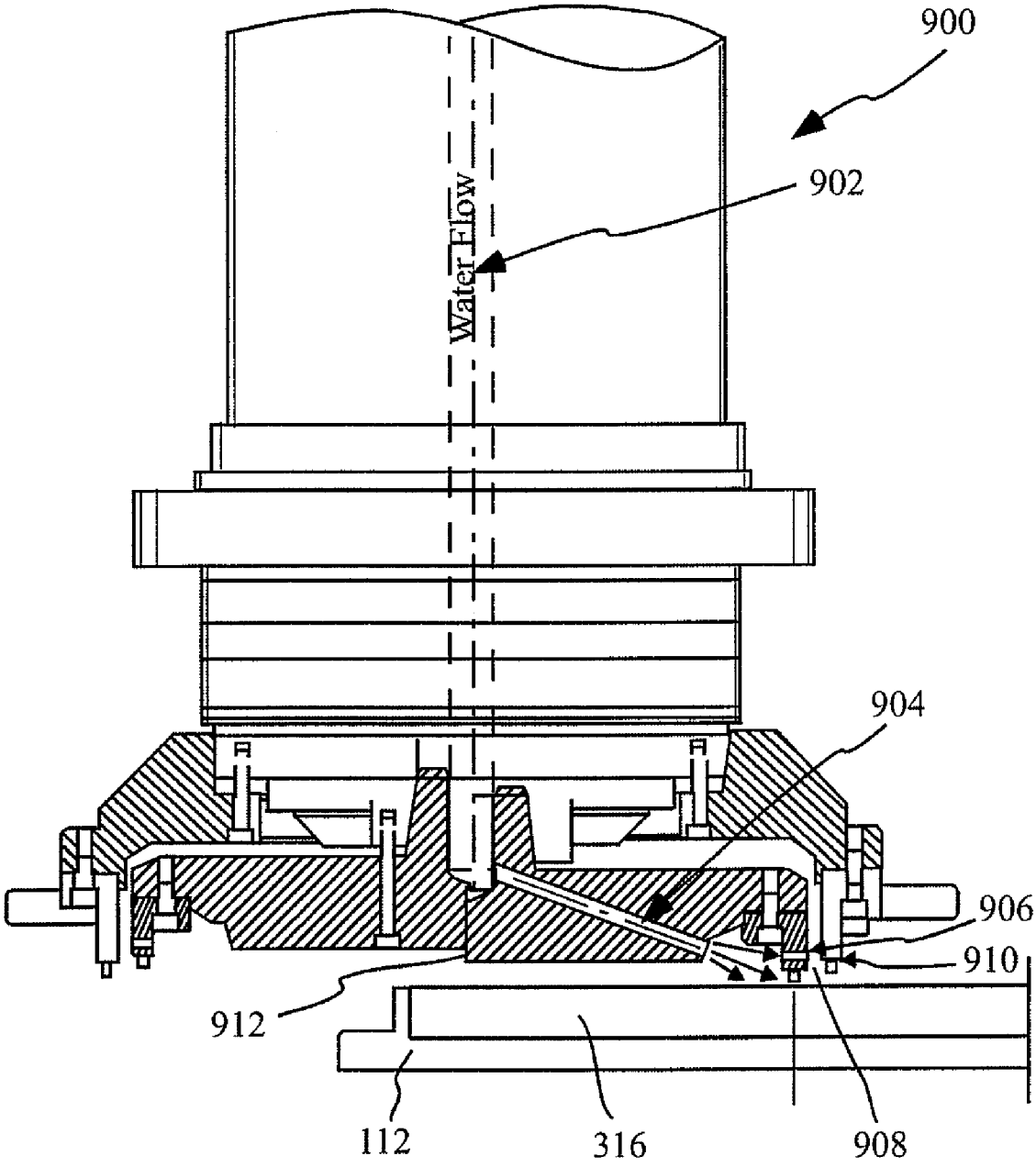
FIG. 9 is a sectional view of a grind spindle with a coolant feed system in accordance with one embodiment of the present invention.
Figure 12B:
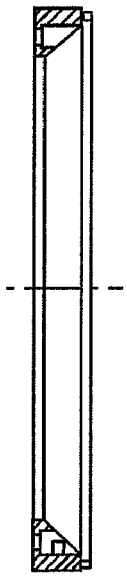
FIGS. 12A and 12B are plan and side views respectively of an inner grind wheel in accordance with one embodiment of the present invention.
Figure 12A:
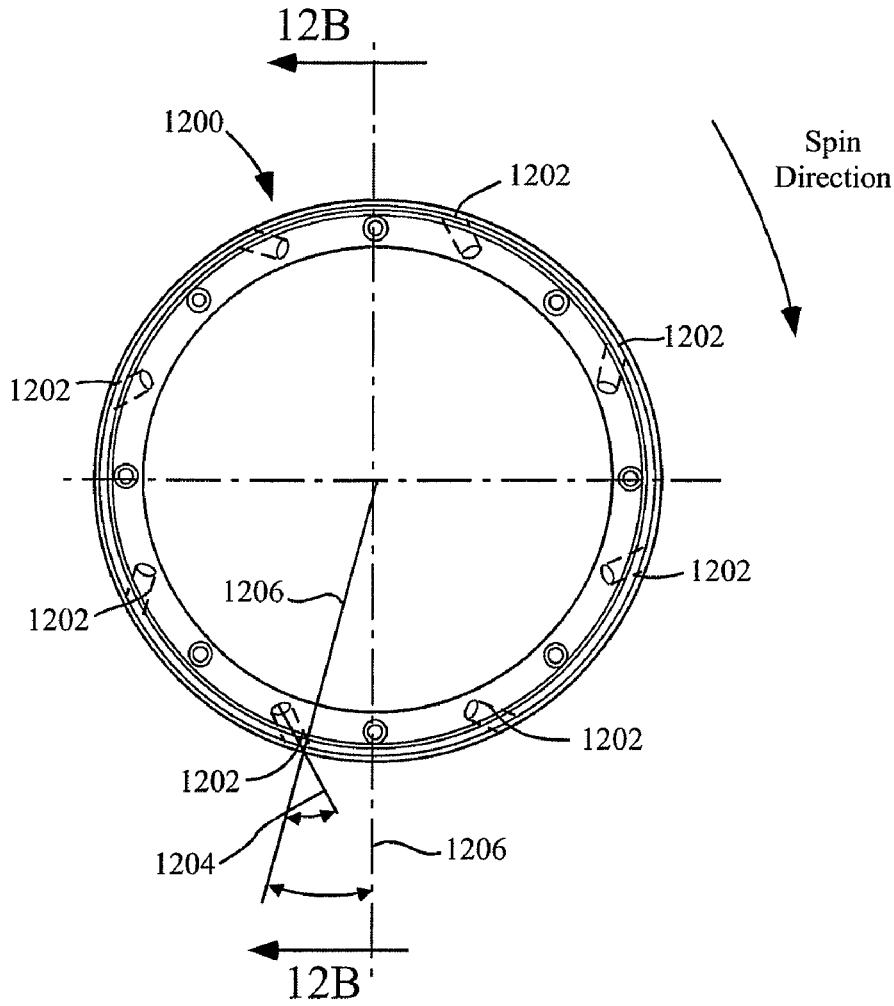

In some embodiments, as discussed further with respect to FIGS. 9, 12A and 12B, an inner grind wheel comprises several coolant passages that facilitate movement of coolant outwardly in the direction of an outer grind wheel so that the outer grind wheel is cooled while it is removing material from a work piece.

Figure 14:
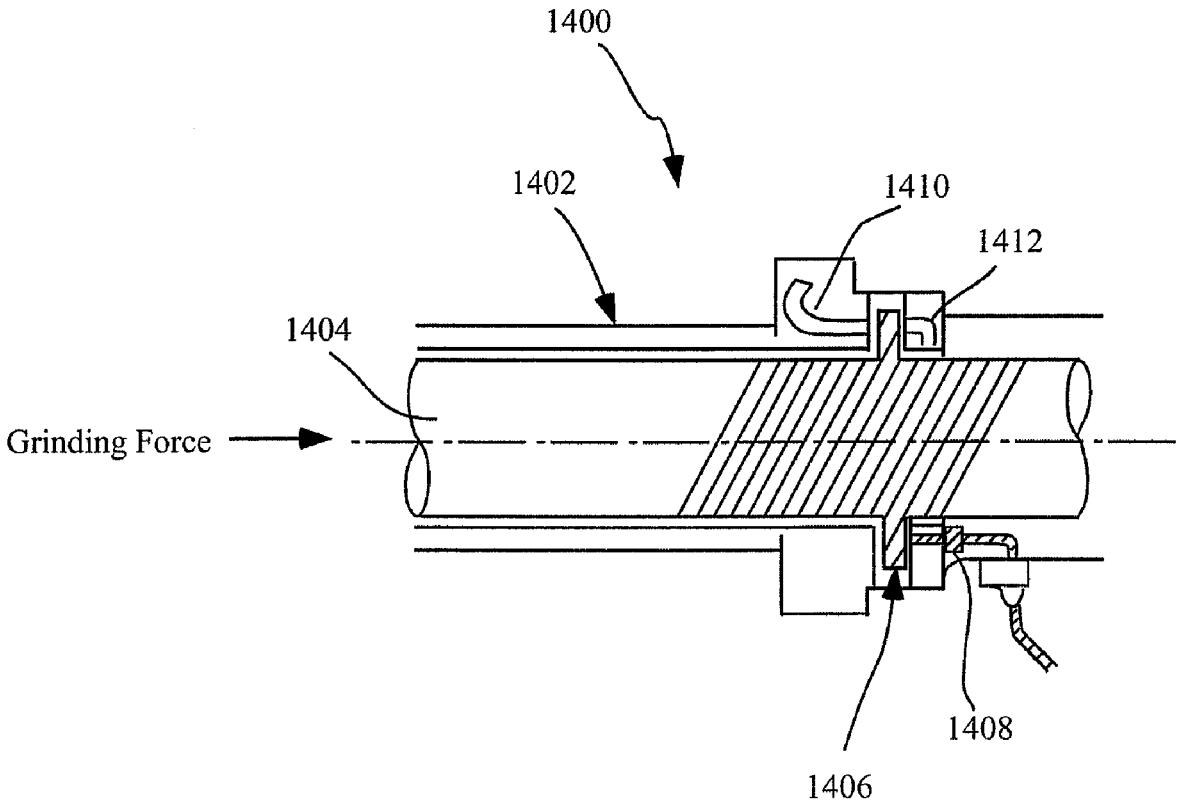
FIG. 14 is a sectional view of a work spindle utilizing a non-contact sensor in accordance with one embodiment of the present invention.

As described further with reference to FIGS. 14 and 15, while a grind wheel on the grind spindle 102 is removing material from a work piece positioned on the chuck 112, axial forces are imparted from the grind wheel to the work piece, from the work piece to the chuck 112 and from the chuck 112 to a chuck spindle within the work spindle 106. An air bearing provided in the work spindle 106 supports the chuck spindle, and the amount of force required to axially displace the chuck spindle against the air bearing varies in a known linear fashion. Thus, by measuring movement of the chuck spindle, an amount of axial force imparted by the grind spindle on the work piece is determinable.

As described further with reference to FIGS. 14 and 15, in several embodiments, a feedback control loop is implemented so that a measure of the chuck spindle displacement is fed back to a grind spindle controller, and the grind spindle controller utilizes this information to help maintain a more constant grinding force on the work piece, and hence, to provide more efficient grinding.

The compact grinder assembly according to several embodiments provides high precision grinding, e.g., to one micron Total Thickness Variation (TTV). To help achieve such precision, in several embodiments, dual air bearing spindles, an air bearing feed axis, and a work spindle detector are utilized in conjunction with the feed back control system, and automatic wheel dressing (discussed further herein with respect to FIG. 16).

In particular, grinding force impacts the TTV significantly, and as grinding is undertaken, the grinding characteristics of the grinding wheel changes and the grinding force becomes a variable while feed rate and other variables are maintained close to constant. Because grind force variation negatively impacts, among other things, the TTV of the wafer, to counter act the force variation, two remedial solutions are possible, a change in feed rate or wheel dressing.

In several embodiments, as discussed further with reference to FIGS. 14, 15, and 16, a control algorithm is implemented to adjust feed rate and/or initiate a dressing of the grind wheel based upon grind force limits established in a grind recipe. Beneficially, the adjustments made by the compact grind assembly to control grinding force are transparent to the user.

Thus, in several embodiments, the compact grinder assembly is a highly automated and highly efficient edge and face grinding tool that has the ability to carry out course and fine grinding with a single grind spindle 102 instead of several independent tools.

Figure 2:
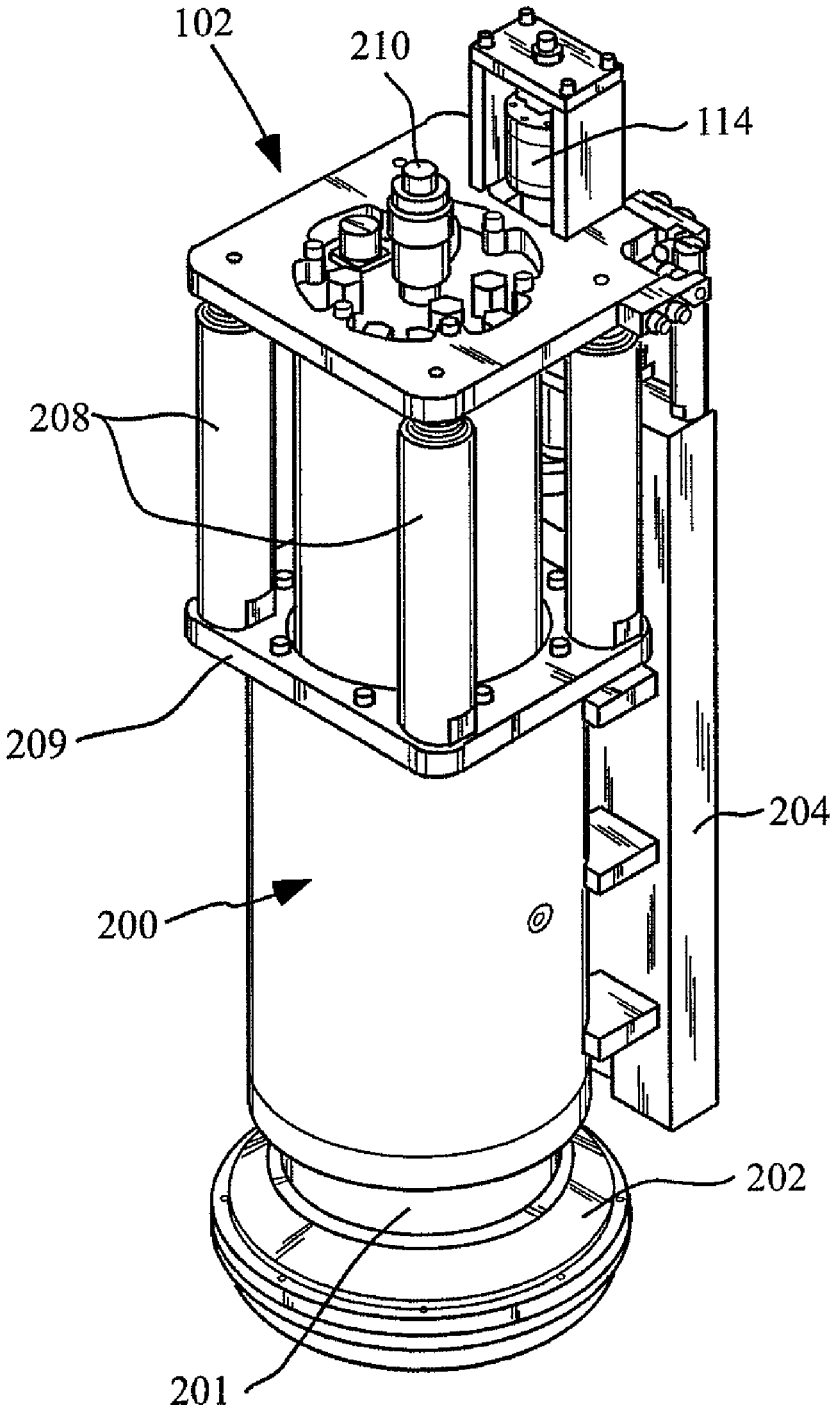
FIG. 2 is a perspective view of one embodiment of the grind spindle of FIG. 1.

Referring next to FIG. 2, shown is a perspective view of one embodiment of the grind spindle 102 of FIG. 1. Shown are an air bearing housing 200 of the grind spindle 102, an air bearing spindle 201, a flange 202, an air bearing assembly 204, spring supports 208, a rotary union 210, and the ball-screw drive 114. Shown coupled with the air bearing housing 200 are a spring mount 209, the air bearing assembly 204 and the ball-screw drive 114.

The flange 202 in several embodiments supports one of two independent grind wheels (not shown), for example, a fine grind wheel.

As discussed, the ball-screw drive 114 provides relative movement between the grind spindle 102 and the spindle support column 104, and thus relative movement between the grind spindle 104 and the work spindle 106. Specifically, once the grind spindle 102 is laterally positioned over a work piece, the ball-screw drive 114 is utilized to lower a grind wheel of the grind spindle 102 into contact with the work piece.

As discussed further herein with respect to FIG. 9, coolant is fed through the rotary union 210, through the grind spindle 102 and to the flange 202 to cool a grind wheel that is engaged with a work piece.

Referring next to FIG. 3, shown is a partial view of a grind spindle 300 performing edge grinding of a work piece in accordance with one embodiment of the present invention. Shown is an inner wheel holder 308 and an inner grind wheel 306. Although the inner wheel holder 308 and inner grind wheel 306 are solid pieces, the grind spindle 300 of FIG. 3 is shown as two halves 302, 304 split along an axis of the grind spindle to illustrate two modes of operation. Specifically, the left half 302 shows the inner grinding wheel 306 and the inner grinding wheel holder 308 in a retracted position, and the right half shows the inner grinding wheel 306 and the inner grinding wheel holder 308 in an extended position. Also shown are an outer wheel holder 310, an outer grind wheel 312, an edging wheel 314, a wafer 316 and the chuck 112.

As shown in FIG. 3, the inner grind wheel 306 and the outer grind wheel 312 are disposed substantially parallel with the axis 307 of the grind spindle 102, and the edging wheel 314 is radially disposed with respect to the axis 317.

Figure 5:
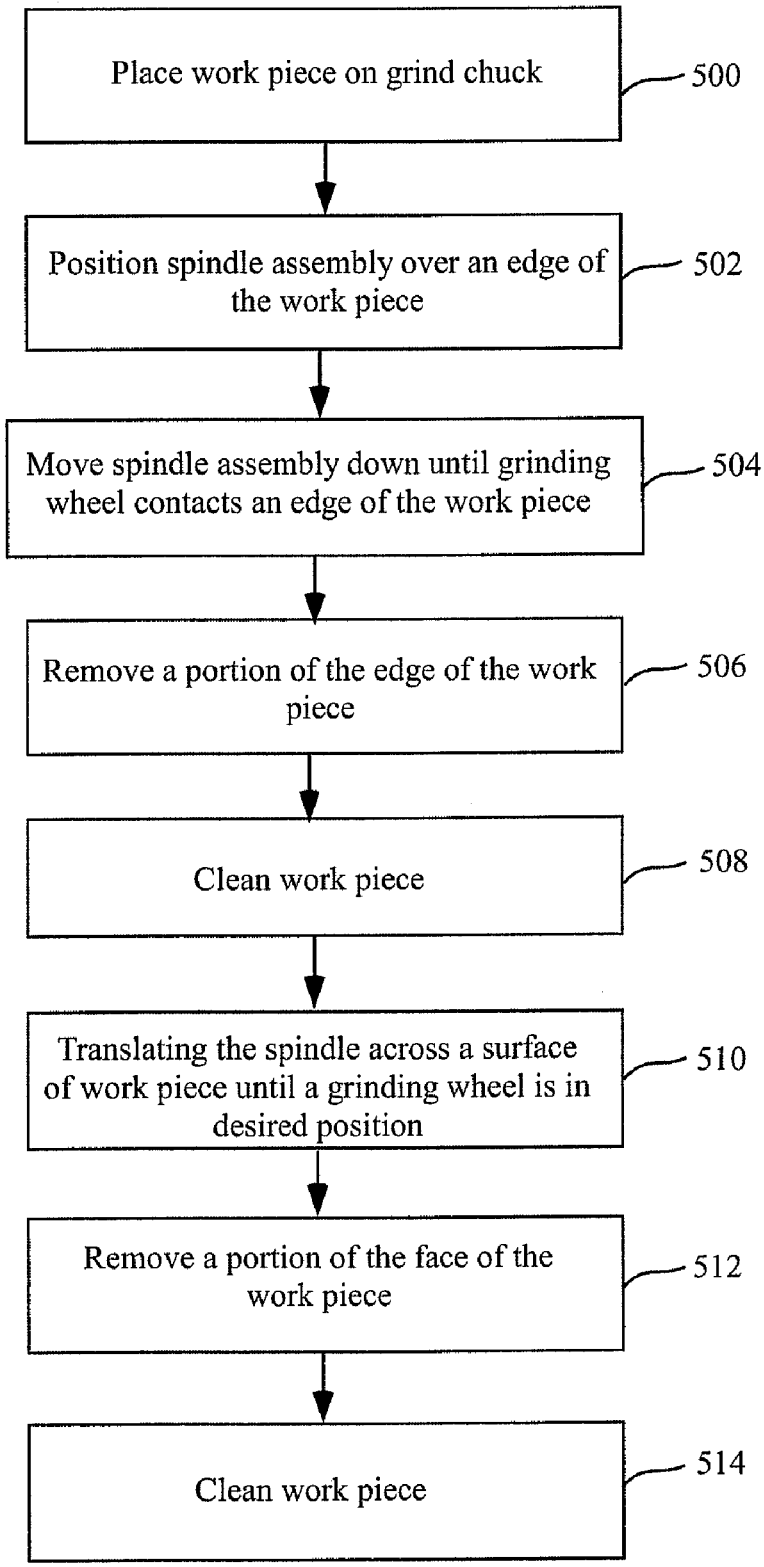
FIG. 5 is a is a flow chart illustrating steps traversed by a compact grinding assembly in accordance with several embodiments of the present invention.

While referring to FIG. 3, simultaneous reference will be made to FIG. 4, which shows the grind spindle 300 positioned with the inner grinding wheel 306 placed in contact with the wafer 310 to perform face grinding, and FIG. 5, which is a flow chart illustrating steps traversed by a compact grinding assembly, e.g., the grinding assembly 100, when performing edge and face grinding according to several embodiments of the present invention.

Figure 6A:
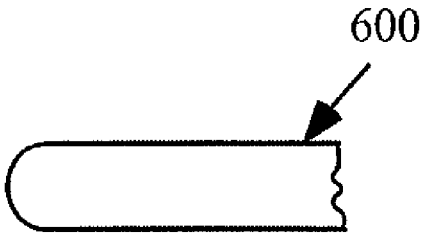
FIGS. 6A and 6B are partial side views of a single un-ground wafer and an un-ground bonded wafer pair respectively.
Figure 6B:
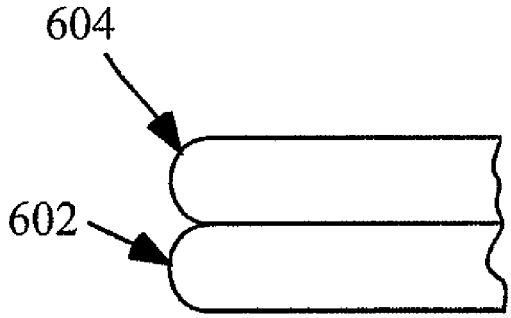

Initially, a work piece is placed on the chuck 112 (Step 500). In some embodiments, the work piece is a single wafer 600 such as is shown in FIG. 6A. In other embodiments, the work piece is a bonded wafer pair such as is shown in FIG. 6B which includes a carrier wafer 602 and a top wafer 604. It will be recognized, however, that the present embodiment is applicable to a variety of different types and configurations of work pieces.

After a work piece is placed on the chuck 112, the grind spindle 300, in some embodiments, is positioned over an edge of the work piece (Step 502). In some embodiments, such as shown in FIG. 3 for example, the edging wheel 314 is positioned over an edge of the work piece. In other embodiments, one of either the inner or outer grinding wheels 306, 312 is positioned over the edge of the work piece.

Once the grind spindle 300 is positioned over the edge of the work piece, e.g., an edge of the wafer 600, or an edge of the top wafer 604, the grind spindle is moved down until a desired grinding wheel contacts the edge of the work piece (Step 504). As shown in FIG. 3 the grinding wheels 306, 308, 314 of the grinding assembly 300 and the chuck 112 are rotating in the same direction, and because the grinding assembly 300 and the chuck are axially offset, a portion of the edge of the work piece is removed when one of the grinding wheels 306, 308, 314 of the grinding assembly comes into contact with the of the work piece (Step 506).

Figure 7A:
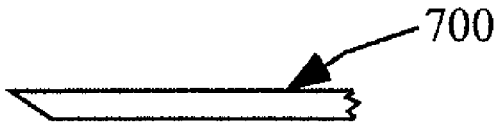
FIGS. 7A and 7B are partial side views of a single wafer and a bonded wafer pair that have undergone face grinding without pre-grinding an edge of the single wafer and the top wafer respectively.
Figure 7B:
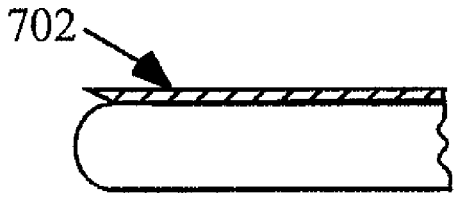

It should be recognized that in other embodiments, face grinding is performed before edge grinding, and that either one of the grinding wheels 306, 312 may be utilized for such grinding. As shown by the ground wafer profile 700 in FIG. 7A, however, when a single wafer undergoes face grinding prior to edge grinding, an undesirable sharp and fragile edge can be created. Similarly, as shown in FIG. 7B, when a top wafer, e.g., the top wafer 604, undergoes face grinding without first shaping an edge of the top wafer potentially results in a delicate, sharp and fragile edge shown on the top wafer 702 that is formed as a result of an un-ground rounded edge.

Figure 8A:
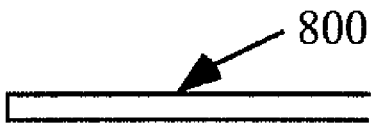
FIGS. 8A and 8B are partial side views of a single wafer and a bonded wafer pair that have undergone pre-shaping of their respective edges before face grinding.
Figure 8B:
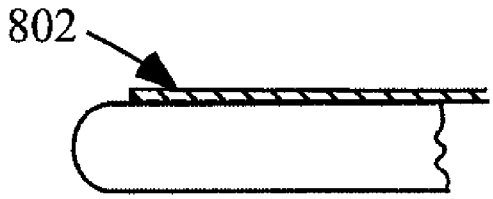

Conversely, when the edge is shaped before face grinding, a desirable blunt edge is produced as is shown by the ground wafer edge 800 shown with reference to FIG. 8A. Similarly, with proper pre-grinding of a top wafer edge before face grinding, a more robust top wafer 802 is formed with a blunt edge, which resists breaking and chipping. These are two examples of where combining the edge grinding and face grinding concepts have beneficial results of less wafer handling steps and less manufacturing cost from the merging of face and edge grinding in the same tool.

Referring next to FIG. 9, shown is a grind spindle 900 with a coolant feed system in accordance with one embodiment of the present invention. The grind spindle 900 shown in FIG. 9 is substantially the same as the grind spindle 300 described with reference to FIGS. 3 and 4 with the addition of an axial coolant duct 902, a coolant nozzle 904, and passages 906 through an inner grind wheel 908.

As shown in FIG. 9, the axial coolant duct 902 is disposed along an axis of rotation of the grind spindle 900 and engages the coolant nozzle 904, which is shown within an inner wheel holder 912. The passages 906 are shown within the inner grind wheel 908 and coolant flow is shown between the nozzle 904 and the passages 906.

In operation, a flow of grinding coolant (typically de-ionized water with or without additives) moves down through the rotating spindle via a rotary union into the coolant duct 902 and then into the nozzle 904 within the inner wheel holder 912 as illustrated. The coolant cools and cleans the grinding area of the inner grind wheel 908 when it is down in the grinding position. But when the inner grind wheel 908 is in an up position, the coolant flow to the outer grind wheel 910 is facilitated by the placement of the passages 906 in the inner grind wheel 908, which allow coolant to pass through the inner grind wheel 908.

In some embodiments, due to a special orientation and shape, the passages 906 actually pump coolant directly onto an area of contact between the outer grind wheel 910 and the work surface, providing cooling and cleaning of grind swarf (such as the nozzle 904 does when the inner grind wheel is down in the grinding position).

Figure 10:
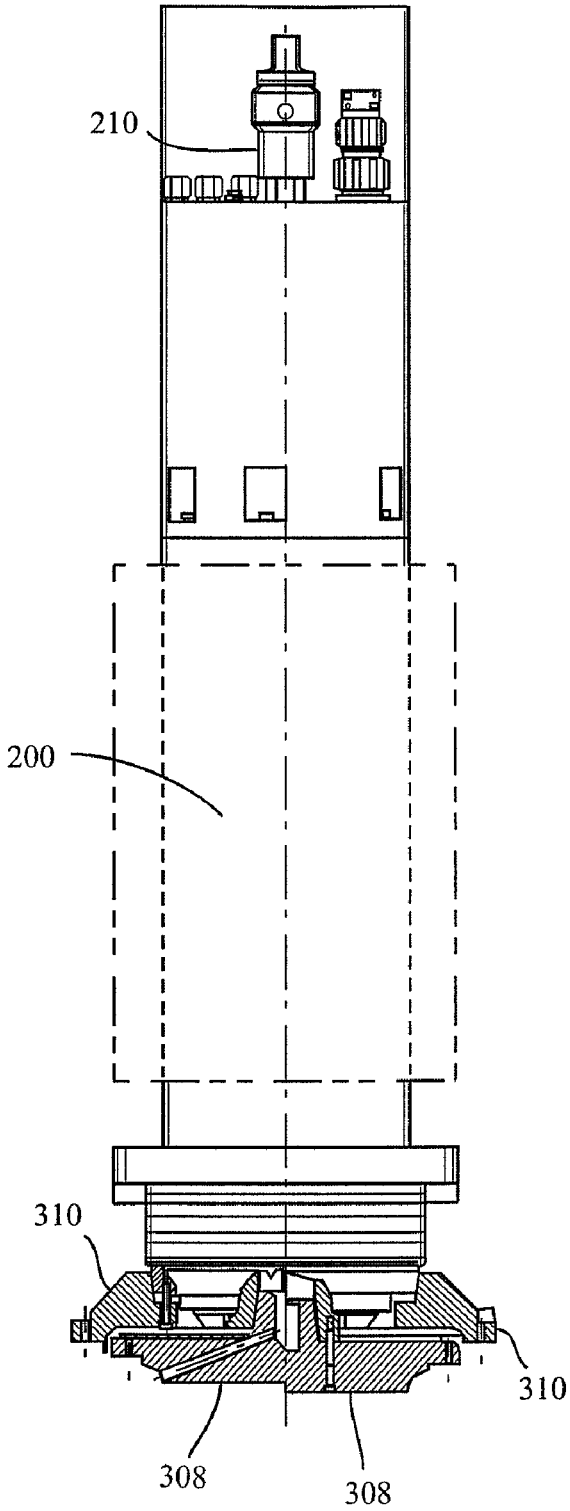
FIG. 10 is a side view of a grind spindle illustrating outer portions of the grind spindle of FIG. 1 in accordance with one embodiment of the present invention.

Referring next to FIG. 10, shown is a side view of a grind spindle illustrating outer portions of the grind spindle 102 of FIG. 1 in accordance with one embodiment of the present invention. Shown are the inner wheel holder 308, the outer wheel holder 310, the air bearing housing 200 and the rotary union 210. To show detail of the inner wheel holder 308 and the outer wheel holder 310 the inner and outer grind wheels 306, 312 are not shown.

Figure 11:
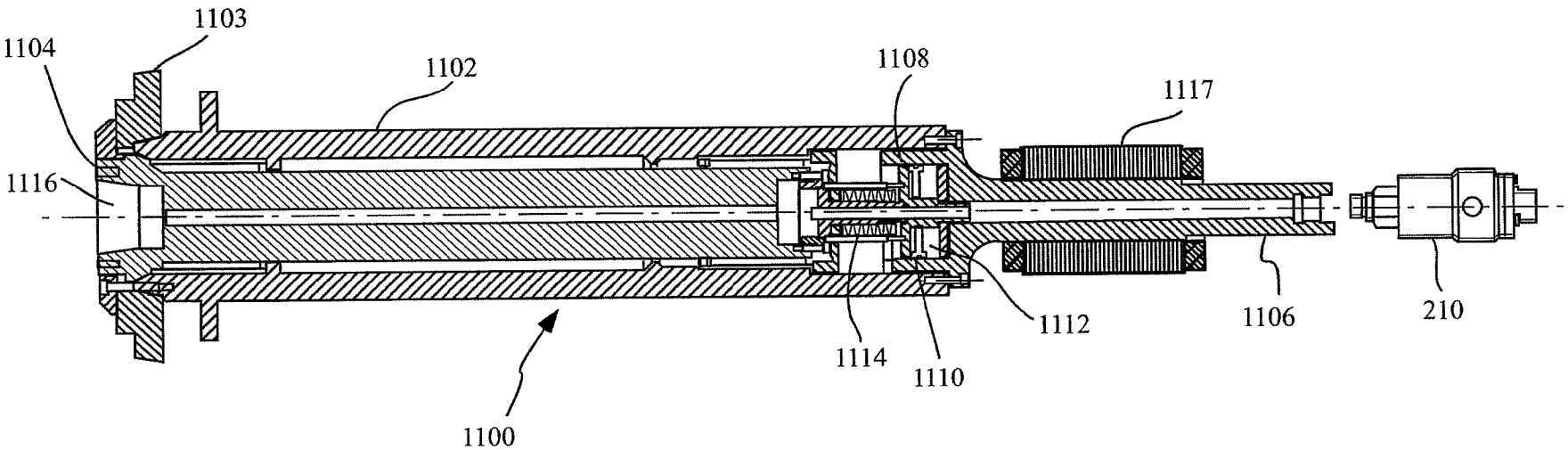
FIG. 11 is a sectional view of an inner spindle of the grind spindle of FIG. 1 in accordance with one embodiment of the present invention.

Referring next to FIG. 11, shown is an inner spindle 1100 of the grind spindle 102 of FIG. 1 in accordance with one embodiment of the present invention. Shown is an outer shaft 1102, and coupled to the outer shaft 1102 are an outer wheel mount 1103, and a spindle drive shaft 1106. The spindle drive shaft 1106 is shown with an end in position to engage the rotary union 210. Also shown are an air containment wall 1112 coupled to the spindle drive shaft 1106, a piston 1108 that is movably coupled to the spindle drive shaft 1106 and a chamber 1110 between the air containment wall 1112 and the piston 1108. On a side of the piston 1108 opposite of the chamber 1110, is a spring assembly 1114, and coupled to the spring assembly 1114 is an inner shaft 1104. At an end of the inner shaft 1104 opposite the spring assembly 1114, the inner shaft 1104 includes an inner flange 1116 where the inner wheel holder 308 is mounted. Also shown coupled to the spindle drive shaft 1106 is a rotor portion 1116 of an induction motor (not shown).

In operation, rotational motion of both the outer and inner shafts 1102, 1104 is produced by rotation of the rotor portion 1116 when the induction motor is activated. In the present embodiment, both the inner and out shafts rotate at the same time.

Unless actuated, the inner shaft 1104 is maintained in a retracted position by force imparted by the spring assembly 1114, which in some embodiments is a series of alternately oriented and stacked Bellville Spring Washers. Referring back to FIG. 3, for example, the inner grinding wheel 306 is shown in a retracted position in the left portion 302 of the illustration.

To extend an inner grinding wheel (e.g., the inner grinding wheel 306) into a grinding position, air or other fluid, e.g., hydraulic, is forced into the chamber 1110 (such as by using an air compressor and air feed lines), and the air pushes the piston 1108 with enough force to overcome the spring assembly 1114 and move the inner shaft 1104 axially away from the rotary union 210. At the same time, the outer shaft continues to rotate, but remains in a fixed position with respect to the rotational axis of the outer and inner shafts 1102, 1104.

To retract the inner grinding wheel, air is removed from the chamber 1110 (such as by opening a three-way-valve) and the spring assembly 1114 pushes the inner shaft 1104 axially back in the direction of the rotary union 210.

Referring next to FIGS. 12A and 12B, shown are plan and side views respectively of an inner grind wheel 1200 in accordance with one embodiment of the present invention. Shown within the inner grind wheel 1200 are several passages 1202 that allow coolant to pass through the inner grind wheel 1200 and reach an outer grind wheel, e.g., the outer grind wheel 312. Each of the passages is shown with an axis 1204 that intersects a radius 1206 of the inner grind wheel 1200 at an outer edge of the inner grinding wheel 1200.

As shown in FIG. 12, in some embodiments, the passages are angled with respect to the radius 1206 of the inner grinding wheel 1200 so that each passage 1202 has an axial, a radial and a tangential component with respect to a rotational direction of the inner grinding wheel 1200. In one embodiment, for example, each passage is angled so that its axis is between 35 and 55 degrees offset from the radius 1206, e.g., 40 to 50 degrees offset, by further example, 45 degrees offset from the radius 1206 of the inner grinding wheel 1200.

In this way, when the inner grinding wheel is rotated, coolant on an interior portion of the inner grinding wheel is pumped outwardly by a combination of centripetal acceleration of the rotating coolant and forces imparted by the angled cooling passages 1202 on the coolant as the passages 1202 impact with the coolant. This pumping action facilitates cooling of an outer grinding wheel that is engaged in grinding a work piece.

Figures 13A, 13B:
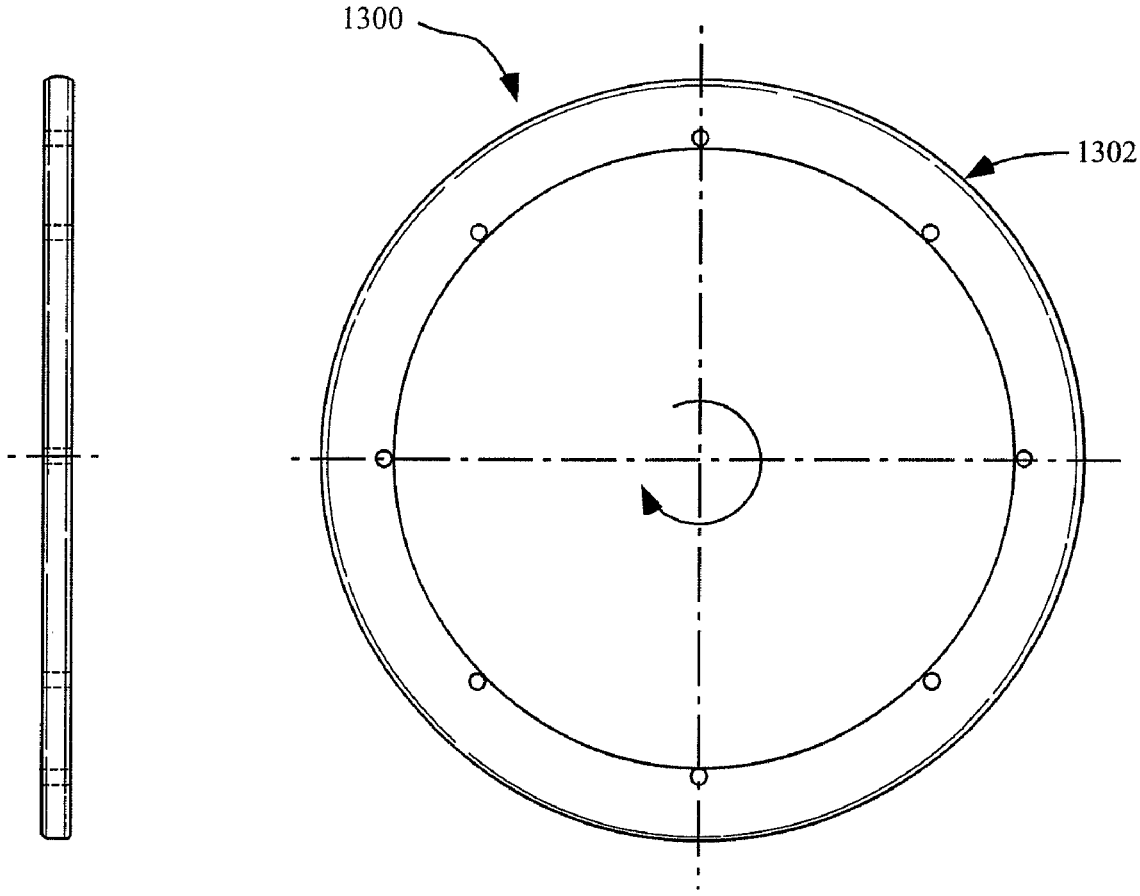
FIGS. 13A and 13B are a plan and side views of an edging wheel for grinding edge portions of a work piece in accordance with one embodiment of the present invention.

Referring next to FIGS. 13A and 13B, shown are a plan and side view of an edging wheel 1300 for grinding edge portions of a work piece in accordance with one embodiment of the present invention.

In several embodiments, the edging wheel 1300 is sized and configured to mount on an outer grinding wheel, e.g., the outer grind wheel 312 and rotate with the outer grind wheel. The edging wheel 1300 of the present embodiment operates in the same way as the edging wheel 314 described with reference to FIG. 3, i.e., a grinding portion of the edging wheel 1302 is extended in a radial direction from a grind spindle's axis of rotation.

Referring next to FIG. 14 shown is a sectional view of a work spindle 1400 in accordance with one embodiment of the present invention. Shown are an air bearing housing 1402, a chuck spindle 1404, a thrust plate 1406, a non-contact sensor 1408, a front thrust air inlet 1410 and a rear thrust air inlet 1412.

The chuck spindle 1404 is shown coupled to the thrust plate 1406, and both the chuck spindle 1404 and the thrust plate 1406 are within the air bearing housing 1402. A left portion of the chuck spindle 1404 is coupled to a chuck (not shown) that supports a work piece. The non-contact sensor 1408 is schematically shown positioned at a bottom of the air bearing housing 1402 and in close proximity to the thrust plate 1406 on a side of the thrust plate 1406 that is opposite the chuck end of the chuck spindle 1404. The front thrust air inlet 1410 is shown at a top portion of the air bearing housing 1402 and positioned so as to impart air at a front face of the thrust plate 1406 (i.e. a face of the thrust plate facing towards a chuck on the chuck spindle 1402). The rear thrust inlet 1412 is shown positioned opposite the front thrust air inlet 1410 so as to impart air at a rear face of the thrust plate 1406.

The front thrust air inlet 1410 and the rear thrust air inlet 1412 provide air pressure on each side of the thrust plate 1406, and given the air pressure maintained in the thrust plate, an amount of force to displace the thrust plate axially a given distance is readily known because the force required to displace the thrust plate 1406 increases linearly with its displacement. In one embodiment, for example, axial stiffness is approximately $1.5\times10^6$ lbf/in.

In operation, when a work piece is undergoing grinding, axial forces from a grind wheel impinging upon a surface of the work piece translate to the chuck, the chuck spindle 1404, and hence, to the thrust plate 1406. These axial forces tend to push the drive shaft away from the grinder, and thus, the thrust plate 1406 moves closer to the non-contact sensor 1408 which is stationary on the outside of the work spindle 1400.

The non-contact sensor 1408 is positioned and configured to detect axial movement of the thrust plate with respect to the non-contact sensor 1408 and provide an output, e.g., a voltage output, that is proportional to the displacement of the thrust plate 1406. In this way, the non-contact sensor 1408 provides a measurement of the displacement of the thrust plate 1406 due to grinding forces imparted upon work piece by a grinding wheel.

The non-contact sensor 1408 in some embodiments is an eddy current sensor, and in other embodiments is a capacitive non-contact sensor. One of ordinary skill in the art recognizes, however, that other types of sensors are available and the present invention is not limited by a specific type of sensor.

As a result, an amount of force imparted from a grinding wheel may be calculated by measuring the axial displacement of the thrust plate 1406 the displacement measurement from the non-contact sensor 1408 is readily related to an amount of force imparted by a grinding wheel.

In several embodiments, the calculated force is utilized to modulate the axial force applied by a grind wheel upon a work piece to maintain a steady force upon the work piece. Providing a steady force beneficially provides a more efficient grinding process.

Figure 15A:
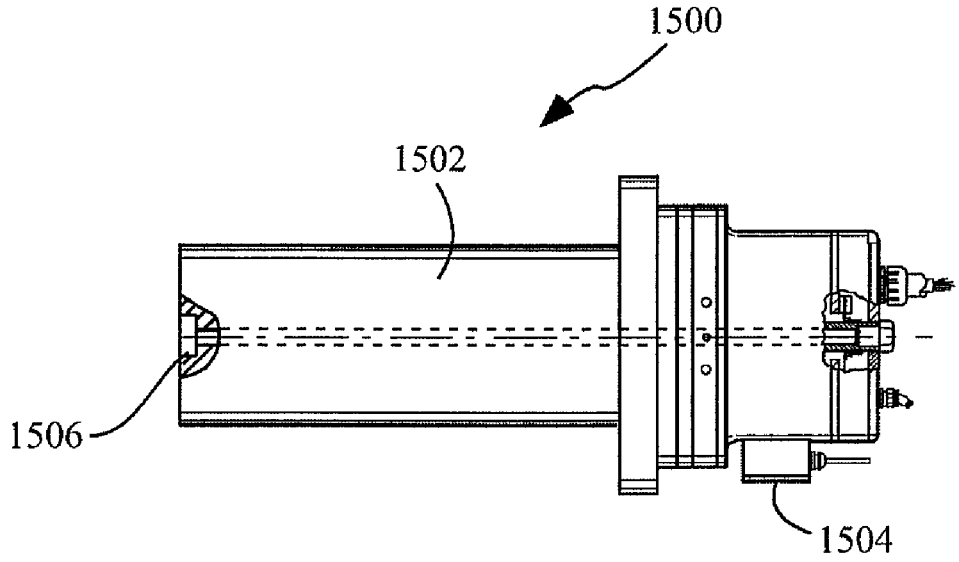
FIGS. 15A, 15B and 15C are exterior side, bottom and top views respectively of a work spindle of FIG. 1 utilizing a non-contact sensor in accordance with one embodiment of the present invention.
Figure 15B:
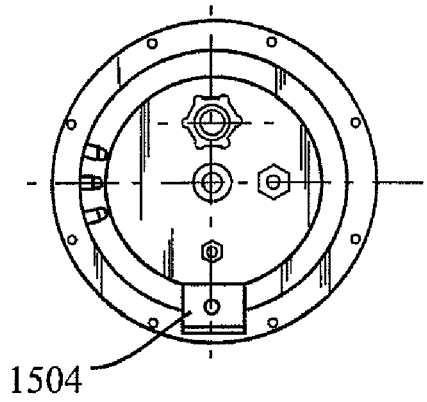
Figure 15C:
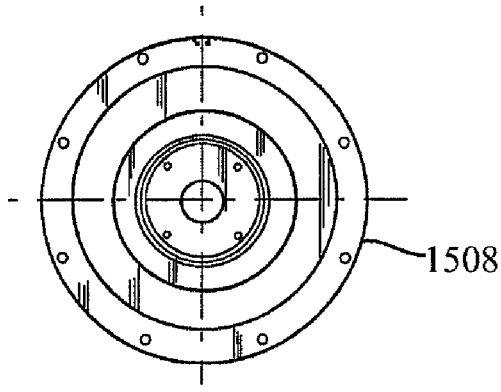

Referring next to FIGS. 15A, 15B and 15C shown are exterior side, bottom and top views respectively of a work spindle 1500 utilizing a non-contact sensor in accordance with one embodiment of the present invention. Shown are an air bearing housing 1502, a non-contact sensor 1504, a chuck spindle 1506 and a flange 1508.

In several embodiments, a chuck, e.g., the chuck 314, is coupled to the chuck spindle 1506 and the chuck spindle 1506 supports and rotates the chuck on which a work piece is placed.

Within the work spindle 1500 are the chuck spindle 1506 that is coupled, as shown in FIG. 14, with a thrust plate (not shown). The non-contact sensor 1540 is positioned in the same manner with respect to the thrust plate as shown in FIG. 14.

Advantageously, the calculated force in some embodiments is utilized to sense when a grinding wheel requires dressing. When a grinding wheel's ability to grind is reduced because the grinding wheel needs dressing, more axial force is required to remove a given amount of material from a work piece than is otherwise required. This increased axial force translates into an increased axial displacement of the thrust plate, e.g., the thrust plate 1406 in the work spindle 1400, 1500. As discussed, the non-contact sensor 1408, 1505 provides a signal that reflects an increased axial displacement, and thus, the non-contact sensor 1408, 1505 in some embodiments also provides an indication that grinding wheel dressing is required.

In some embodiments, when the grinding wheel needs to be dressed, a grinding wheel is brought into contact with a dressing wheel while both the grinding wheel and the dressing wheel are rotating.

Figure 16A:
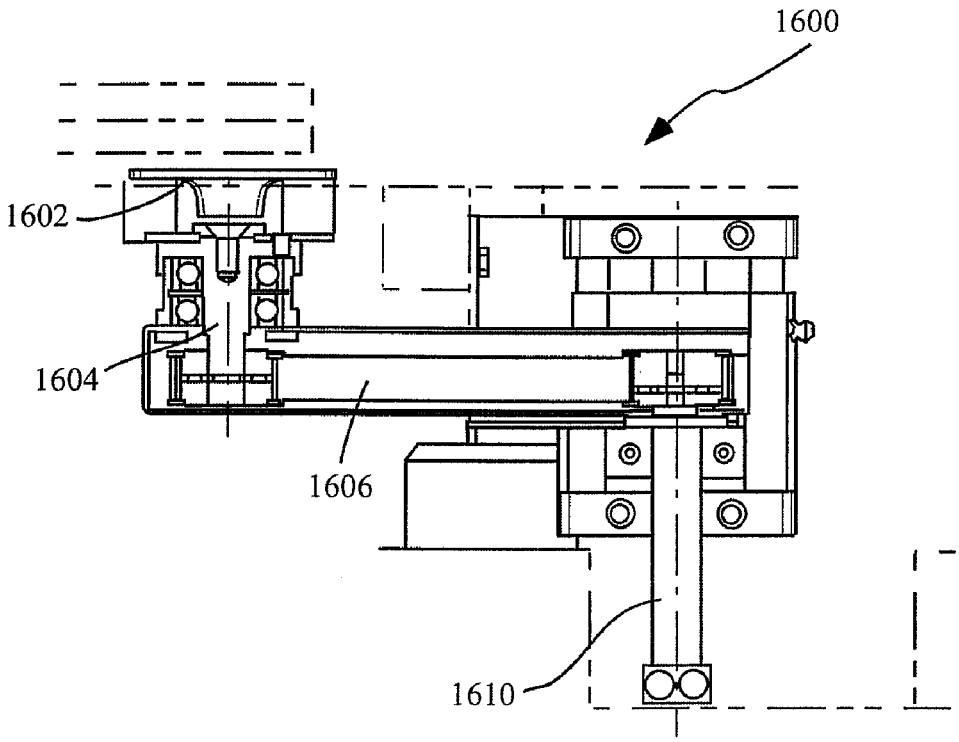
FIGS. 16A and 16B are a front and plan view respectively of a wheel dresser assembly 1600 for dressing an abrasive portion of a grinding wheel in accordance with one embodiment of the present invention.
Figure 16B:
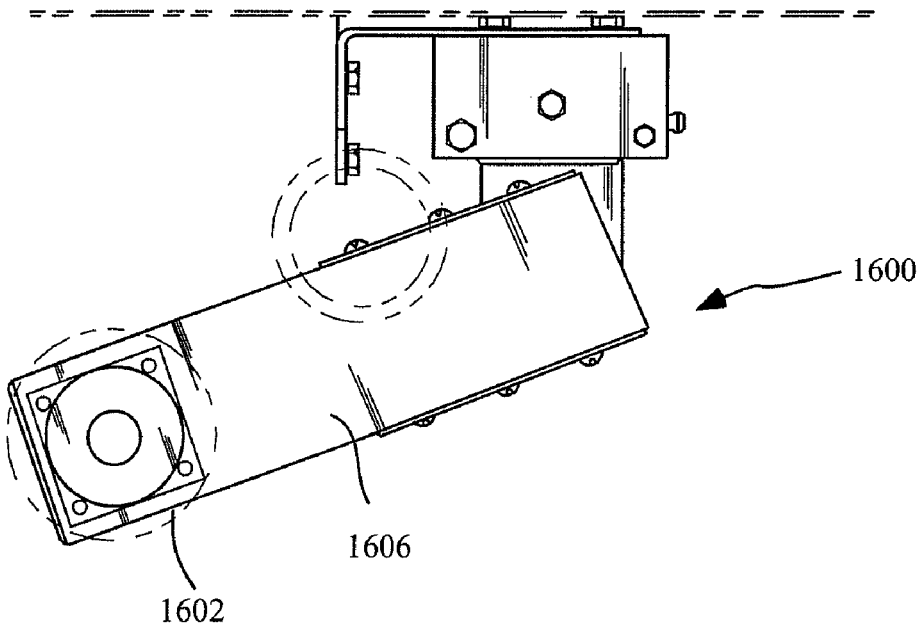

Referring to FIGS. 16A and 16B, for example, shown are a front and plan view respectively of a wheel dresser assembly 1600 for dressing an abrasive portion of a grinding wheel in accordance with one embodiment of the present invention. Shown are a dressing disc 1602, a disk drive spindle 1604, an arm support 1606, a turbine motor drive 1610 and a pneumatic cylinder assembly 1612.

The dressing disc 1602 is coupled on top of the disk drive spindle 1604, and the air motor 1610 is coupled to the disk drive spindle 1604 by a drive belt inside the arm support 1606. The arm support 1606 is coupled to the pneumatic cylinder assembly 1612, which actuates vertical motion of the arm support 1606 and dressing disk 1602.

In operation, when a work piece is undergoing shaping by a grinding wheel, and the grind wheel needs to be dressed, because efficacy of the grinding wheel begins to degrade for example, the dressing disc is raised up from below a portion of the grinding wheel extending beyond the work surface until the dressing disc comes into contact with that portion of the grinding wheel that is overlapping beyond an edge of the work piece. In this way, the grinding wheel may be dressed at the time the grinding wheel is engaged with, for example grinding, the work piece. This allows dressing of the grinding wheel without having to slow down or stop the grinding process, thus saving time and money and producing a better quality work product.

In several embodiments, the dressing disc 1602 is rotated about its axis by the air motor 1604, and the pneumatic cylinder assembly 1610 operates vertical movement, i.e. parallel to the rotational axis of the dressing disc 1602, of both the arm support 1606 and the dressing disc 1602.

As discussed with reference to FIGS. 14 and 15, in several embodiments, a non-contact motion sensor is utilized to measure displacement of a chuck spindle, e.g., the chuck spindle 1404, due to grinding forces, and a force imparted by a grinding wheel is calculated from the measured displacement. In some of these embodiments, this calculated force is utilized to trigger the dressing process described with reference to FIG. 16.

In one embodiment for example, a signal output of the non-contact sensor 1408, 1504, e.g., a voltage, is fed to a control portion of the dressing assembly (not shown), and when the signal exceeds a threshold level, the pneumatic cylinder assembly 1610 is actuated to move the arm support 1606, and hence, the dressing disc 1602 vertically until the dressing disc comes into contact with the grinding wheel.

In several embodiments, a "Grinder control Algorithm" to coordinate grinding enhancements in order to fully achieve customer grind quality expectations when grinding work products such as silicon wafers. The Algorithm is executed by a machine and motion control system, e.g., provided by Giddings and Lewis, operating on a Personal Computer. Several technology advances are implemented in the compact grinder assembly 100, 1800, 1900, and it is the function of the Algorithm to integrate these advancements seamlessly with traditional grinding functions so as to achieve superior grinding results for brittle material face and edge grinding of work pieces such as silicon wafers. Superior results include maintaining Total Thickness Variation (TTV) over the wafer surface of ~0.1 micron with surface finish of ~5 nanometer Rma and final thickness target to within 1 micron.

This is achieved in several embodiments by accurate and continuous monitoring the grinding normal force and adjusting feed rate of spindle and/or abrasive wheel conditioning to remain within certain bands defined by the user: e.g., at feedrate between x and x+e, force shall be between y and y+f. If force falls above y+f, feed rate will be reduced in 10% reduction increments each 10 seconds until force once again falls into proper band (y to y+f). If force cannot be reduced by automatic reduction of federate to the minimum value of y, then abrasive dressing will be initiated. As dressing "sharpens" the wheel, force will reduce and feed rate can be returned to nominal feed rate. The exact values for the trip points depend upon the materials being ground, the type of grinding abrasive wheels, and the final quality and throughput requirements. The final thickness is obtained by monitoring of the actual thickness during grinding.

In yet another embodiment, motor current of the grind spindle is monitored, and when the current reaches a threshold level, the dressing assembly is actuated.

Thus, in several embodiments, wheel dressing is carried out automatically while a work piece is being shaped, and therefore, downtime ordinarily taken to stop grinding and manually dress the grinding wheel is greatly reduced or eliminated.

In several embodiments, the dressing assembly 1600 is mounted in the same cabinet, e.g., the cabinet 108 as a compact grinding assembly, e.g., the compact grinding facility 100. Thus, in some embodiments a unitary grinding assembly is provided that includes edge and face grinding as well as automatic grind wheel dressing.

Figure 17:
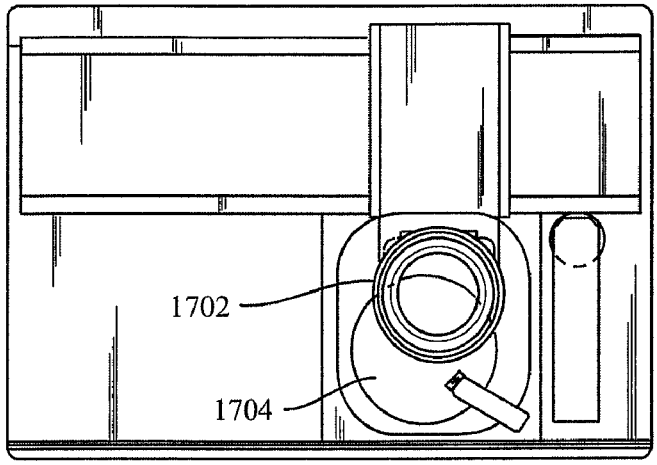
FIG. 17 a plan view of a compact grinder assembly configured in accordance with one embodiment of the present invention.

Referring next to FIG. 17, shown is one embodiment of a compact grinder assembly 1700 in accordance with one embodiment of the present invention. As shown, the compact grinder assembly 1700 in the present embodiment is much like the compact grinder assembly 100 described with reference to FIG. 1. Specifically, the compact grinder assembly 1700 includes a single grind spindle, a single work spindle, and thus, a single chuck 1704. The present embodiment provides many advantages, including edge and face grinding in a single machine, over prior systems, but does not incorporate other processing hardware involved with cleaning and/or post-grinding polishing, for example.

Figure 18:
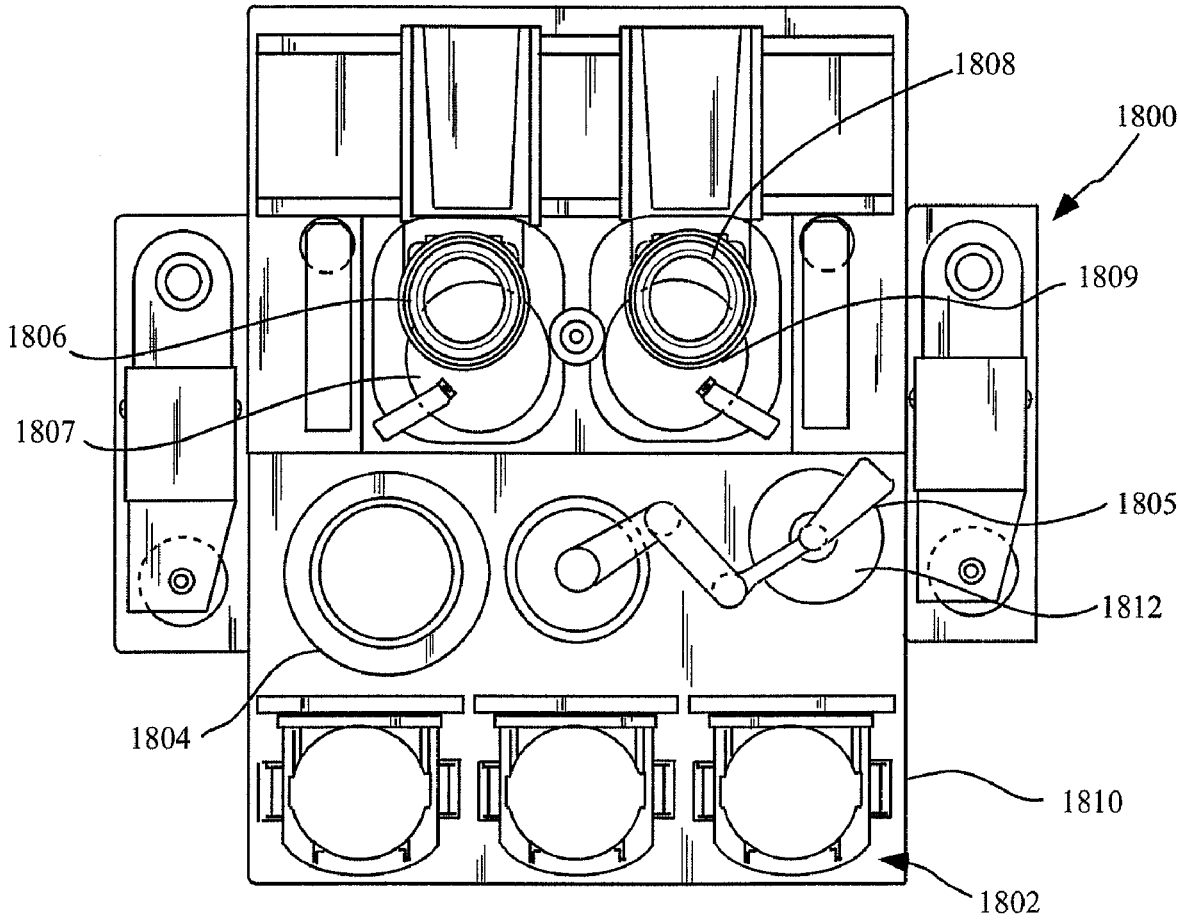
FIG. 18 is a plan view of another compact grinder assembly in accordance with another embodiment of the present invention.

Referring next to FIG. 18, shown is a plan view of another compact grinder assembly 1800 in accordance with another embodiment of the present invention. Shown are a set of three wafer pods 1802 (also referred to as Front Opening Unified Pods (FOUPS) 1802), a cleaning station 1804, first and second grind assemblies 1806, 1808 a housing 1810, and a pre-aligner 1812.

As shown, the FOUPS 1802, the cleaning station 1804 and the first and second grind assemblies 1806, 1808 are all within the same housing 1810.

In operation, a robot arm 1805, shown adjacent to the cleaning station 1804, retrieves a wafer from one of the wafer pods 1802, pre-aligns the wafer on the pre-aligner 1812 so the wafer is positioned properly on the robot arm 1805, and then places the wafer on a chuck, e.g., either a first chuck 1807 positioned below the first grind spindle 1806 or on the second chuck 1809 positioned below the second grind spindle 1808. Once the wafer is in place the robot arm 1805 again retrieves another wafer, pre-aligns the wafer and places it in the unoccupied chuck. Thus, simultaneous grinding is carried out in the compact grinder assembly 1800 of the present embodiment.

Additionally, as one wafer is being ground, another wafer may be cleaned. Thus, the compact grinder assembly 1800 in the present embodiment is a compact high-throughput grinder. Furthermore, because cleaning is also performed, i.e., at the cleaning station 1804, within the compact grinder assembly 1808, high throughput grinding and cleaning are carried out in the same housing 1802 that beneficially occupies a very small footprint.

Figure 19:
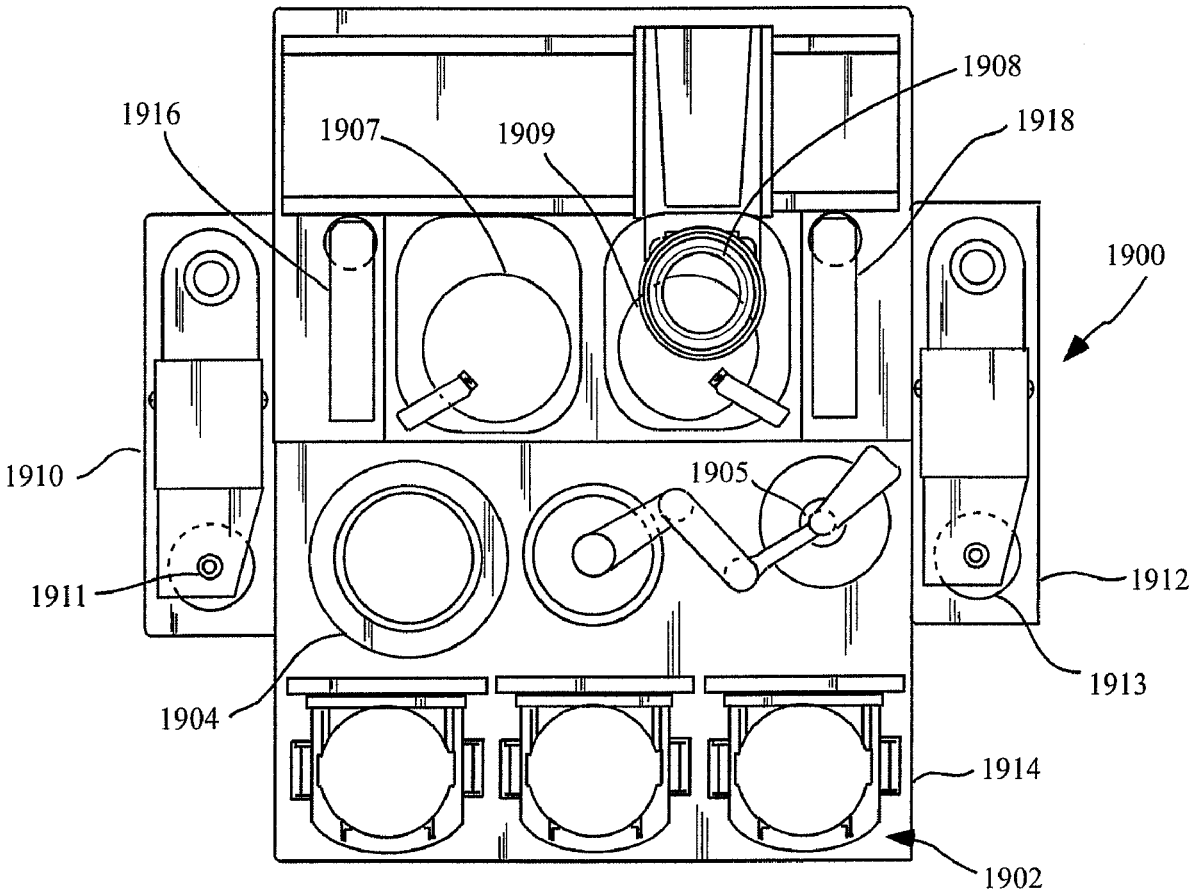
FIG. 19 is a plan view of yet another compact grinder assembly in accordance with yet another embodiment of the present invention.

Referring next to FIG. 19, shown is a plan view of yet another embodiment of a compact grinder assembly 1900 in accordance with another embodiment of the present invention. Shown are a set of three wafer pods 1902 (also referred to as Front Opening Unified Pods (FOUPS) 1902), a cleaning station 1904, a grind spindle 1908, a first chuck 1907, a second chuck 1909, a first stress relief station 1910, a second stress relief station 1912 and a housing 1914.

As shown, the FOUPS 1902, the cleaning station 1904, the grind assemblies 1908, the first stress relief station 1910, the second stress relief station 1912 are all coupled to the housing 1914 as a unitary piece of equipment.

In operation, the compact grinding assembly 1900 performs the same steps as the compact grinding assembly 1800 of FIG. 18 except the present compact grinding assembly 1900 includes only one grind spindle, i.e., the grind spindle 1908, so simultaneous grinding of two wafers is not carried in the present embodiment.

Additionally, the compact grinding assembly 1900 in the present embodiment allows stress relief polishing to be conveniently carried out after grinding. This is especially useful when producing thin flexible wafers, e.g., wafers between 30 and 180 microns. Specifically, polishing wheels 1911, 1913 of the first and second stress relief stations 1910, 1912 respectively are rotated to polish work pieces on the first and second chucks 1907, 1909 respectively. After polishing, the wafers are cleaned at the cleaning station 1904 and returned to the FOUP 1902. Such processing is often required in order to prepare wafers for applications where flexibility is required, e.g., credit card applications and smart card applications.

Also shown are a first and second work chuck scrubbers 1916, 1918 for cleaning the first and second chucks 1907, 1909 respectively between grinding wafers to help assure that no dirt is between the wafer and chucks 1907, 1909; thus helping to keep the wafer flat during grinding.

Beneficially, two chucks are available in the present embodiment, i.e., the first and second chucks 1907, 1909, that allow a wafer to be pulled from the FOUPS 1902, aligned and positioned on the unoccupied chuck while a wafer is being shaped in the other occupied chuck. Thus, higher throughput efficiencies are obtained over embodiments that have only a single work spindle and chuck.

It should be recognized that a wheel dressing assembly, e.g., the wheel dressing assembly 1600, may be added to any of the three embodiments described with reference to FIGS. 17, 18 and 19 to provide the additional benefits of automated and ongoing wheel dressing in a compact and economical unitary package.

While the invention herein disclosed has been described by means of specific embodiments and applications thereof, numerous modifications and variations could be made thereto by those skilled in the art without departing from the scope of the invention set forth in the claims.

What is claimed is:

1. A method for grinding comprising:

positioning a grind spindle comprising a first grinding portion over a work piece;

contacting the first grinding portion to a face of the work piece;

removing a portion of the face of the work piece; and controlling the removing of the portion of the face of the work piece according to a control algorithm comprising:

determining a force applied to the work piece during the removing of the portion of the face;

adjusting a feed rate of the grind spindle when the force applied to the work piece has a predefined relationship with a first threshold level; and dressing a portion of the first grinding portion when the force applied to the work piece has a predefined relationship with a second threshold level that is different than the first threshold.

2. The method of claim 1, further comprising:

removing a portion of an edge of the work piece with the first grinding portion.

3. The method of claim 2, further comprising:

translating, after removing the portion of the edge, the grind spindle in a parallel direction with respect to the work surface to prepare for the step of removing the portion of the face of the work piece.

4. The method of claim 1, further comprising: removing a portion of an edge of the work piece with a second grinding portion.

5. The method of claim 1, wherein the step of positioning comprises positioning an edging wheel coupled to the grind spindle at an edge of the work piece, wherein a portion of the edge is removed with the edging wheel, where the edging wheel is an additional grinding portion.

6. The method of claim 1 further comprising:

sensing an axial displacement of a work spindle supporting the work piece; and modulating a rate of the removal the portion of the face as a function of the axial displacement.

7. The method of claim 1 further comprising:

positioning a second grinding portion of the grind spindle over a work piece;

contacting the second grinding spindle to a face of the work piece;

delivering a coolant passing a coolant through a plurality of coolant passages of the first grinding portion producing streams of coolant;

contacting the second grinding portion at an intersection of the second grinding portion and the face of the work piece with the streams of coolant.

8. A method of grinding a wafer, comprising:

sensing an axial displacement of a chuck spindle of a work spindle where the axial displacement is along an axis and parallel with a rotational axis of the work spindle, and where the chuck spindle supports a wafer; and modulating an axial force applied to a grinding portion moving the grinding portion parallel with the rotational axis, where the modulating the axial force applied to the grinding portion induces a modulation of an axial force applied by the grinding portion on a face of the wafer during a removal of a portion of the face of the wafer as a function of the axial displacement.

9. The method of claim 8, wherein the modulating the axial force comprising maintaining a steady force upon the face of the wafer by the grinding portion.

10. The method of claim 8, wherein the sensing the axial displacement comprises sensing through non-contact the axial displacement.

11. The method of claim 10, wherein the non-contact sensing comprises sensing a displacement of a thrust plate of a chuck spindle that supports a chuck on which the wafer is placed.

12. The method of claim 11, wherein the thrust plate is positioned within an air bearing.

13. A grinding apparatus comprising:

a grind spindle comprising an axis;

a first face grinding portion engaged with the grind spindle wherein the first face grinding portion rotates about the axis;

a chuck that supports a work piece contacted by the first face grinding portion to grind a portion of a face of the work piece;

an air bearing spindle coupled to the chuck, where the air bearing spindle comprises a thrust plate that is enclosed by a housing with the thrust plate being positioned relative to the housing by an air bearing; and a non-contact sensor positioned and configured to sense displacement of the thrust plate within the air bearing with respect to the housing.

14. The apparatus of claim 13, further comprising:

a controller coupled with the non-contact sensor that determines an axial displacement of the chuck supporting a work piece based on signals received from the non-contact sensor, and modulates an axial force applied by the first grinding portion on the face of the work piece during a removal of a portion of a face of the work piece as a function of the axial displacement.

15. The apparatus of claim 14, wherein the controller implements the modulating of the axial force to maintain a steady force upon the face of the work piece by the grinding portion.

16. The apparatus of claim 13, further comprising:

a second face grinding portion engaged with the grind spindle positioned radially about the first face grinding portion wherein the second face grinding portion rotates about the axis;

the first face grinding portion comprises a plurality of coolant passages each having a terminating portion comprising a length being radially and axially disposed with respect to the axis thereby permitting coolant to flow from within the first grinding portion through the first face grinding portion to the second face grinding portion.

17. The method of claim 1, wherein the dressing the portion of the first grinding portion comprises:

detecting that the force applied to the work piece, after the adjusting of the feed rate of the grind spindle, has the predefined relationship with the second threshold level; and implementing, in response to the detecting that the force applied to the work piece after the adjusting of the feed rate of the grind spindle has the predefined relationship with the second threshold level, the dressing the portion of the first grinding portion.

18. The method of claim 17, wherein the detecting that the force applied to the work piece after the adjusting of the feed rate of the grind spindle has the predefined relationship with the second threshold level comprises detecting that the force applied to the work piece is not reduced sufficiently such that the force applied after the adjusting of the feed rate has the predefined relationship with the second threshold level.

19. The method of claim 18, wherein the adjusting the feed rate of the grind spindle comprises adjusting the feed rate in percentage increments.

* * * * *